United States Patent [19]

Munoz et al.

[11] Patent Number: 5,061,879

[45] Date of Patent: Oct. 29, 1991

[54] DUAL FILAMENT LAMP CONTROL SYSTEM

[76] Inventors: Joseph P. Munoz, 4643 S. Oxford Ave., Tulsa, Okla. 74135; William R. Dickson, 19713 E. 42nd., Broken Arrow, Okla. 74014; Michael S. Cafasso, 2033 S.E. Thousand Oaks Dr., Claremore, Okla. 74017

[21] Appl. No.: 590,816

[22] Filed: Oct. 1, 1990

[51] Int. Cl.[5] ..... H01J 7/44

[52] U.S. Cl. ..... 315/65; 315/93; 315/129; 315/136; 340/642

[58] Field of Search ..... 315/65, 88, 91, 93, 315/129, 136; 340/641, 642

[56] References Cited

U.S. PATENT DOCUMENTS

| | | | |
|---|---|---|---|
| 3,710,367 | 1/1973 | Barnum | 340/641 X |
| 3,801,860 | 4/1974 | King | 315/136 |
| 4,315,196 | 2/1982 | Kitayama | 315/136 X |
| 4,527,095 | 7/1985 | Herring | 315/65 |
| 4,841,196 | 6/1989 | Waymouth | 315/65 |

*Primary Examiner*—Eugene R. LaRoche
*Assistant Examiner*—Do Hyun Yoo

[57] ABSTRACT

The present invention provides a Control Module 15 for controlling a dual filament bulb, in particular aircraft reading lamps, so as to detect the failure of one filament and energize the other filament. The Control Module 15 also has provisions for detection of bulbs that have only one or no operable filament(s) by activating an indicator (Light Emitting Diode) or connection to a test switch that will command the Module to activate bulbs that have two operable filaments only. The Control Module 15 consists of a solid state circuit made up of triacs, resistors, capacitor, diodes and fuse all packaged in a small printed circuit board. Interface between the Module and dual filament bulb, indicator or test switch is easily accomplished by a small connector on the Control Module 15.

1 Claim, 1 Drawing Sheet

DUAL FILAMENT LAMP CONTROL SYSTEM

FIELD OF THE INVENTION

The present invention provides a means for controlling the filaments in a dual filament bulb, in particular aircraft reading lamps, independently of each other as to provide a reserve filament in the event one fails.

BACKGROUND OF THE INVENTION

As many people who fly on airliners will appreciate it is often difficult to read or have a meal without a reading light, specially during night flights. Accordingly there is a need for a backup system in the event of a reading lamp failure. Furthermore the device must be one which will automatically provide light without any human interference.

SUMMARY OF THE INVENTION

The invention consists of a small electronic module which controls the filaments in a dual filament bulb, used particularly in aircraft reading lamps. The module acts as an interface between the passenger ON/OFF control switch and the bulb. The energized filament, in the dual filament bulb, is continually being monitored by the control module for any failure. When the energized filament fails, the control module automatically switches ON the other filament; an optional indicator can be connected to the module and is automatically activated indicating the bulb has only one operable filament, otherwise a test switch connected to the module can be used to identify lamps that have only one or no operable filament(s). The Control Module also extends the life of the bulb due to its inherent design features.

Therefore the module provides for a standby reading lamp and prolongs the life of the bulb.

DESCRIPTION OF THE PREFERRED EMBODIMENT

Figure 1:
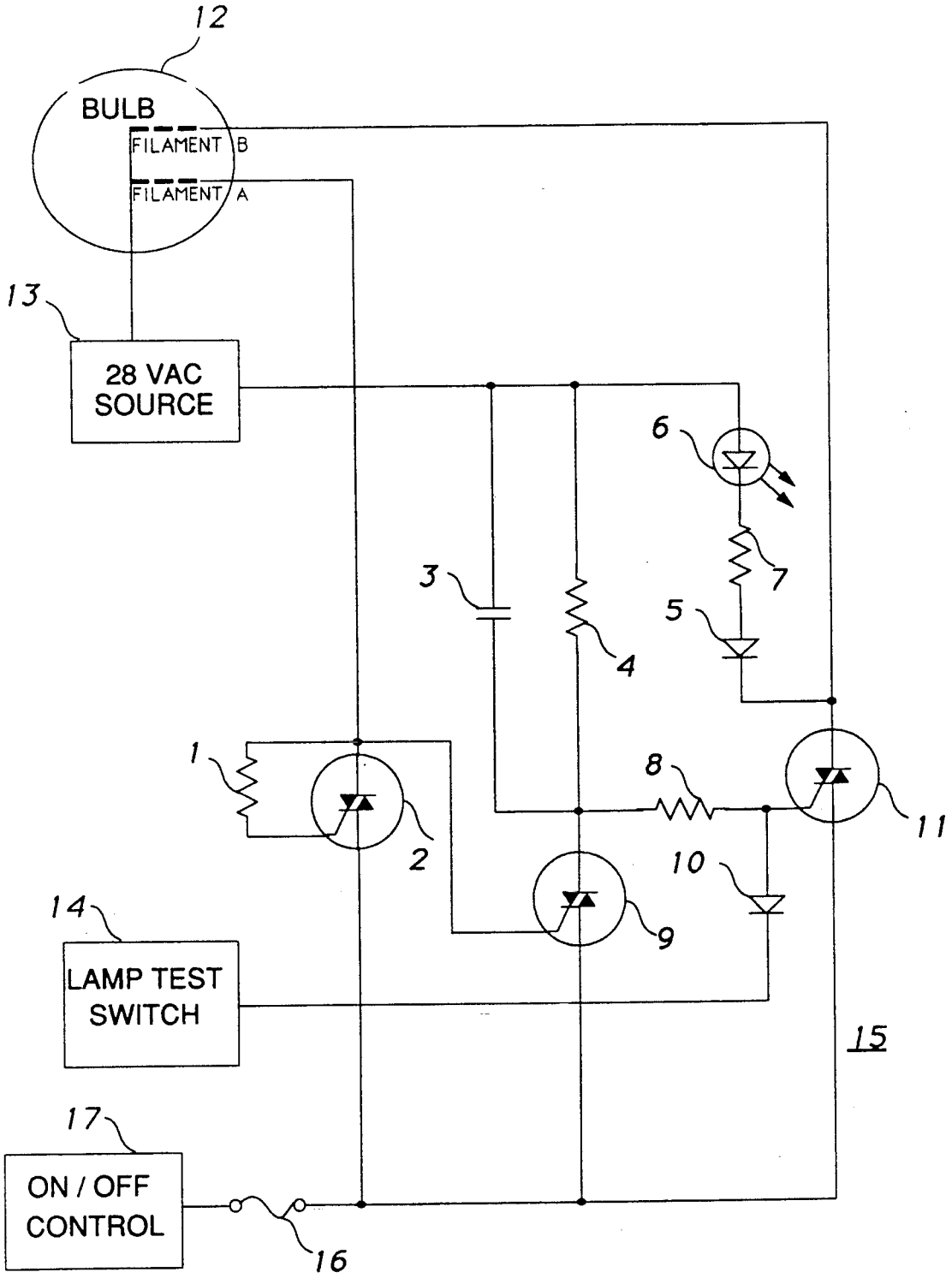
FIG. 1 is a schematic diagram of the Control Module constructed according to the teachings of the invention.

Certain type of environments require a light source that contains a backup system which is automatically activated in the event of a failure. An example is a Dual Filament bulb that is monitored for failure in one of the filaments and activating the other by a certain Control Module.

FIG. 1 is a schematic diagram of a Control Module 15 constructed according to the teachings of the invention, which is suitable in providing control for aircraft reading lamps that contain two filaments, one of them being a backup or for any other application where automatic activation of a standby source is necessary.

The Control Module 15 consists of solid state devices called triacs 2,9 and 11, resistors 1,4,7 and 8, capacitor 3, diodes 5 and 10. Indicator 6 is a light emitting diode that is external to the Control Module 15. The bi-directional semiconductor switches such as triacs 2,9 and 11 perform the failure detection and switching of the bulb 12 filaments A and B. When the ON/OFF Control is in the ON position current flows from the 28 VAC source 13 to bulb 12 filament A and resistor 1, activating triac 2 which energizes the bulb. Triac 2 serves as a current sensor to detect filament A failure; at the same time a small voltage drop developed across triac 2 is sufficient to maintain triac 9 ON, since it is a sensitive gate triac, diverting the current away from the gate of triac 11. Resistor 8 reduces the current flow into the gate of triac 11 keeping it in the OFF state and consequently maintaining bulb 12 filament B in the OFF state. Resistor 4 limits the current through triac 9 for safe and efficient operation of the control module. Capacitor 3 is used for noise suppression; since a triac is essentially an AC switch it can create radio frequency interference when it turns ON and OFF; this has been taken care of by making sure that enough current exists at the gate of the triac at the instance the sinewave crosses the zero point eliminating the high current spikes that create the interference. To accomplish this capacitor 3 will shift the phase angle between the voltage and current to triac 11, making the current lead the voltage and forcing it to arrive at the triac 11 gate before the voltage, therefore as soon the voltage crosses the zero point triac 11 is turn ON if triac 9 is OFF, eliminating the high current spikes and consequently the noise.

When bulb 12 filament A fails, current flow stops through triac 2, turning triac 9 OFF. Sufficient current can now flow into the gate of triac 11 turning it ON and consequently activating bulb 12 filament B; at the same time indicator 6 is energized indicating that the bulb has only one operable filament. Diode 5 and resistor 7 protect the indicator 6 from reverse voltages and high currents respectively.

A test port is available for connection to a test switch 14, so that defective lamps which contain one or no operable filament(s) can be detected; this switch 14 may be used in place of the indicator 6. The lamp test port can be connected to the lamp test switch 14 which when the test switch 14 is closed, thereby opening the triac 11 and darkening the lamp 12 completely if only one operable filament exists. The diode 10 between the test switch 14 and the gate of triac 11 prevents unnecessary turn ON of triac 11.

Miniature fuse 16 isolates the Control Module 15 from the rest of the aircraft reading light system so that no other lights are effected in the event of a Control Module 15 failure.

We claim as our invention:

1. A dual filament reading lamp and control module, used particularly in aircraft, said lamp having a first and second filament and said control module having functions for detecting the failure of said first filament, automatically activating said second filament and activating an indicator called Light Emitting Diode for indicating the failure of said first filament, wherein said control module operates directly from an AC voltage source and said control module comprises bi-directional semiconductor devices to detect the failure of said first filament and activate said second filament and said control module further comprises means including a test port for connection to a test switch for testing for the failure of said first filament without requiring the use of said indicator to indicate said first filament failure.

* * * * *